United States Patent [19]

Niimi

[11] 4,130,043

[45] Dec. 19, 1978

[54] ELECTRONIC MUSICAL INSTRUMENT HAVING FILTER-AND-DELAY LOOP FOR TONE PRODUCTION

[75] Inventor: Koji Niimi, Hamamatsu, Japan

[73] Assignee: Nippon Gakki Seizo Kabushiki Kaisha, Hamamatsu, Japan

[21] Appl. No.: 732,181

[22] Filed: Oct. 13, 1976

[30] Foreign Application Priority Data

Dec. 16, 1975 [JP] Japan ..... 50/149148

[51] Int. Cl.[2] ..... G10F 1/00

[52] U.S. Cl. ..... 84/1.03; 84/1.13; 84/1.19; 84/1.26; 84/DIG. 10

[58] Field of Search ..... 84/1.19, 1.26, DIG. 10, 84/1.11, 1.12, 1.13, 1.03, 1.24; 179/1 D, 1 F, 1 J

[56] References Cited

U.S. PATENT DOCUMENTS

| | | | |
|---|---|---|---|
| 3,515,792 | 6/1970 | Deutsch | 81/1.26 |
| 3,699,233 | 10/1972 | Suzuki | 84/DIG. 10 |

*Primary Examiner*—Robert K. Schaefer
*Assistant Examiner*—Leonard W. Pojunas, Jr.
*Attorney, Agent, or Firm*—Cushman, Darby & Cushman

[57] ABSTRACT

An electronic musical instrument comprises a waveshape memory delivering out digital value samples of one cycle of a certain waveshape, and a loop circuit including a filter and a shift register. The digital waveshape values read out from the waveshape memory is caused to circulate at a predetermined rate of time in the loop circuit. A waveshape taken out from the loop circuit varies as time lapses, and is utilized as a musical tone.

9 Claims, 6 Drawing Figures

ELECTRONIC MUSICAL INSTRUMENT HAVING FILTER-AND-DELAY LOOP FOR TONE PRODUCTION

BACKGROUND OF THE INVENTION

1. Field of the Invention

The present invention relates to an electronic musical instrument for electronically generating a musical tone waveshape.

2. Description of the Prior Art

An electronic musical instrument of a waveshape reading out system which employs a waveshape memory storing a musical sound waveshape either in the analog form or in the digital form, and is operative so that the stored contents are repetitively read out at a given rate of time from said waveshape memory to thereby form a musical tone waveshape, is disclosed in, for example, U.S. Pat. No. 3,515,792 Specification (Inventor: Ralph Deutsch; Title: DIGITAL ORGAN).

In an electronic musical instrument, in general, which employs the above-mentioned system, the musical tone waveshape which is read out from the waveshape memory is always constant in amplitude (tone volume) and tone color relative to time. Accordingly, in order to impart the musical tone a variation of amplitude (envelope) with time, the instrument is arranged in general so as to multiply the musical tone waveshape read out from the waveshape memory by an amplitude factor which varies with time. With such a known arrangement, there can be attained a variation of tone volume of the musical tone in accordance with the passage of time. Nevertheless, it is not possible to obtain such a musical sound that its tone color varies with time. In order to attain a variation of tone color with time, it is necessary according to the prior art to further pass the musical sound waveshape read out from the waveshape memory through a complicated variable filter arranged so that its frequency characteristic varies with time.

As stated above, in case it is intended to generate a musical tone which is rich in variation and in expression by the use of an electronic musical instrument employing the known waveshape reading out system, it is necessary to equip this instrument with very complicated and expensive peripheral circuits. Thus, it is quite difficult to obtain, from an electronic musical instrument of a simple structure, such a decaying musical sound as the sound of a piano, a guitar, a harp and a xylophone, whose tone volume exhibits a decay with time and yet is accompanied with variation of tone color.

SUMMARY OF THE INVENTION

It is, therefore, an object of the present invention to provide an electronic musical instrument which is capable of easily generating various kinds of musical tones whose tone volume and tone color vary with time.

According to the present invention, there is provided an electronic musical instrument wherein there are provided a waveshape generator for generating a waveshape in an amount defining at least one cycle at a certain time rate, and a loop circuit including a filter and a delaying circuitry. The waveshape delivered out from the waveshape generator is caused to circulate at a predetermined rate of time in the loop circuit, and thus an aimed musical waveshape is obtained repeatedly from a point of this loop circuit.

This and other objects as well as the features and the advantages of the present invention will become apparent by reading the following detailed description of the invention in connection with the preferred examples when taken in conjunction with the accompanying drawings.

DETAILED DESCRIPTION OF THE PREFERRED EMBODIMENTS

Figure 1:
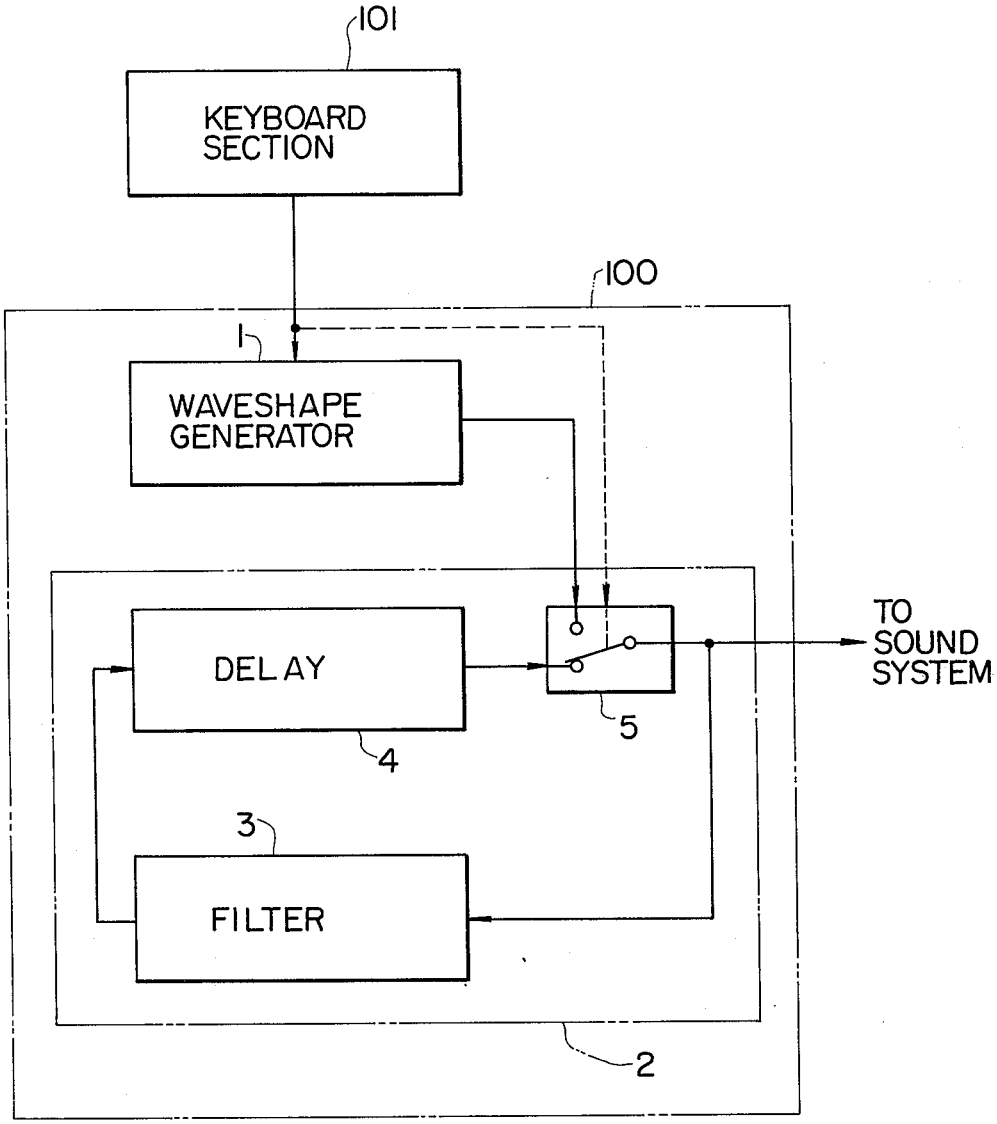
FIG. 1 is a block diagram showing a basic construction of the present invention.

A basic construction of the present invention is illustrated in FIG. 1. A waveshape generator 1 produces a waveshape which defines at least one cycle of the wave at a certain time rate. A loop circuit 2 is constituted by connecting a filter 3 and a delay circuit 4 in a loop. A selector 5 is provided in the loop circuit 2 so that the waveshape from the waveshape generator 1 is introduced to the loop circuit at a time and a filtered and delayed waveshape is repeatedly circulated in the loop circuit 2 at another time. In this way, the waveshape generator 1 and the loop circuit 2 constitute a musical tone wave forming section 100. A keyboard section 101 triggers the waveshape generator 1 to produce a waveshape and the selector 5 to initially introduce the waveshape into the loop circuit 2 and subsequently circulate the filtered and delayed waveshape in the loop circuit 2.

Figure 2:
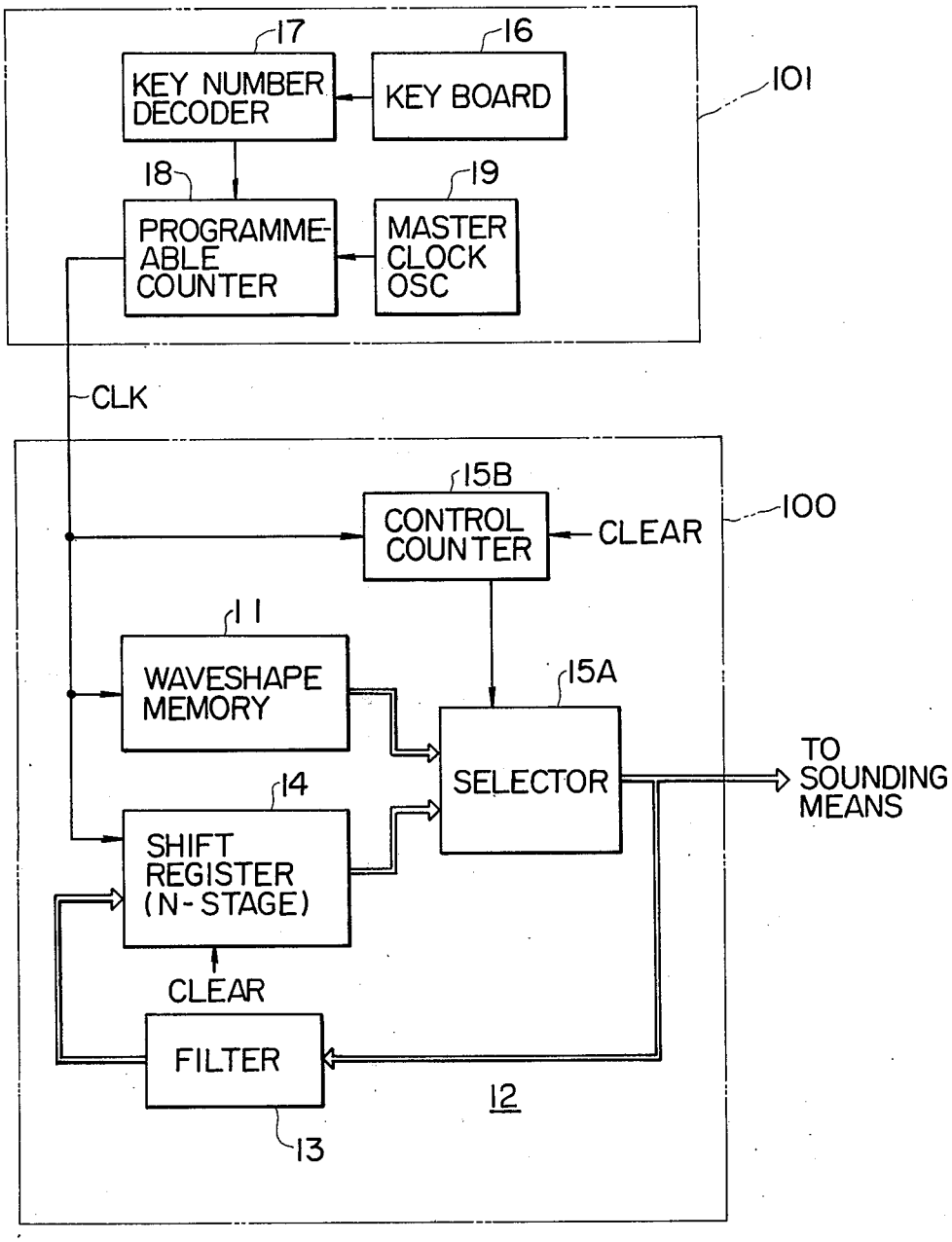
FIG. 2 is a block diagram showing an example of the electronic musical instrument according to the present invention.

A more detailed block diagram of an embodiment of the electronic musical instrument of the present invention is illustrated in FIG. 2. This electronic musical instrument is structurally composed roughly of the following two principal sections, i.e. a musical tone wave forming section 100 including a waveshape memory 11 storing the information of a specific waveshape, which waveshape serves as the base factor of production of a musical tone waveshape, in an amount corresponding to at least one cycle, and a keyboard section 101 for addressing the aforesaid waveshape memory 11 of said waveshape forming section 100.

The waveshape forming section 100 is comprised of a waveshape memory 11, a filter 13, an N-stage shift register 14 serving as a delaying circuit, a selector circuitry 15A and a control counter 15B. The shift register 14 is connected back to the filter 13 via the selector circuitry 15A to form a loop circuit 12.

In the waveshape memory 11 is stored, in a digital representation, the information of a specific waveshape, which serves as the base factor of production of a musical tone waveshape, in an amount defining, for example one cycle of the wave. It will be needless to say that this waveshape memory 11 may be arranged so as to store the waveshape information in an analog form.

The keyboard section 101 is comprised of a keyboard 16, a key number decoder 17, a programable counter 18 and a master clock oscillator 19. When a desired specific key of the keyboard 16 is depressed, the control signal corresponding to this depressed key is generated from the key number decoder 17. Under the control by this control signal, the programable counter 18 counts the clock pulse delivered from the master clock oscillator 19 to generate a clock pulse CLK of a frequency corresponding to the depressed key. Such a keyboard section can be easily constructed according to the teachings described in the specification of U.S. Pat. No. 3,824,379 assigned to the same assignee.

Figure 3:
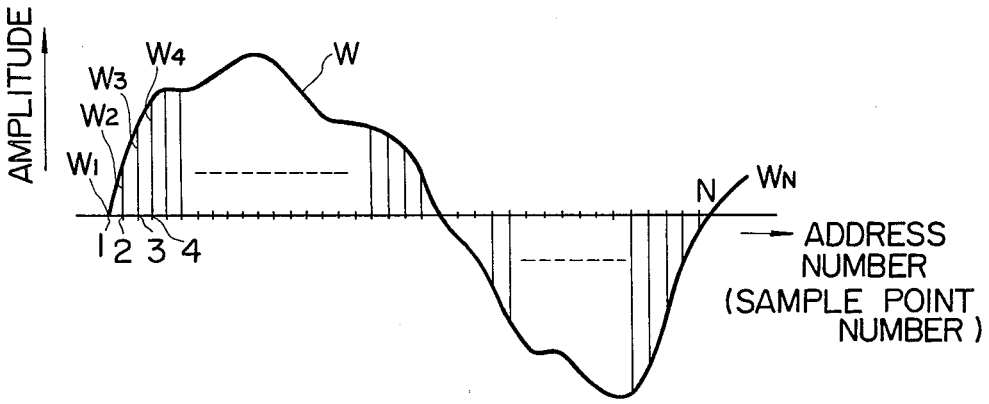
FIG. 3 is an illustration showing an example of the waveshape information stored in the waveshape memory included in the electronic musical instrument shown in FIG. 2.

Referring now to FIG. 3, to make an explanation in further detail, it should be understood that digital representations (in N words) of an N number of sample values $W_1, W_2, \ldots, W_N$ of a specific waveshape W are stored at the addresses No. 1, No. 2, . . . , No. N in the waveshape memory 11, respectively.

Referring again to FIG. 2, explanation will hereunder be made of the behavior of the electronic musical instrument of FIG. 2. When a certain key of the keyboard 16 is depressed, there will be derived a clear pulse from this keyboard 16. By this clear pulse, the contents of the control counter 15B and of the shift register 14 are cleared. At the same time therewith, the programable counter 18 receives a control signal from the key number decoder 17 to generate a clock pulse CLK of a frequency corresponding to the depressed key. At each clock pulse CLK generated from the programable counter 18, the digital representations (N words) of sample values $W_1, W_2, \ldots, W_N$ at the respective sampling points of the waveshape W are read out successively. These digital representations which are thus read out are then supplied via the selector circuit 15A, as the initial one cycle information of the musical tone waveshape, to a sound system not shown but including a digital-to-analog converter. Along therewith, these digital representations are successively placed, via the filter 13, into the shift register 14. The control counter 15B counts the clock pulses CLK. As the N-th clock pulse CLK arrives at this control counter 15B, thereby the digital representation which has been stored in the address No. N is read out, and as the reading out of the information of the stored waveshape of one cycle completes, the control counter 15B generates a switch-over signal. This switch-over signal controls the selector circuit 15A so that the output of the shift register 14 is connected to the input of the filter 13 via the selector 15A, whereby the aforesaid loop circuit 12 is completed.

At this point of time, the one cycle information (N words) of the waveshape W which is stored in the waveshape memory 11 is placed, via the filter 13, into the N-stage shift register 14. The contents of this shift register 14 are shifted one position to the right side at each arrival of the clock pulse CLK. This output of the shift register 14 is then delivered via the selector circuit 15A to the musical tone sounding system not shown. Along therewith, said output is again placed into this shift register 14 via the filter 13. More specifically, the information of N-words read out from the waveshape memory 11 is circulated in the loop circuit 12 at the rate of time of the clock pulse CLK. The waveshape information which appears at an arbitrary point of this loop circuit 12, which in this example is at the output point of the selector 15A, is sent to the sound system not shown as the 2nd cycle, 3rd cycle, . . . , i-th cycle information of the musical tone waveshape, respectively.

More clearly speaking, the 1st cycle information, the 2nd cycle information, the 3rd cycle information, . . . , the i-th cycle information of the musical tone waveshape are formed by the sounding system not shown, based on the following series of information, i.e. the information of N-words read out from the waveshape memory 11, the information of N-words after having once passed through the filter 13, the information of N-words after having twice passed through the filter 13, the information of N-words after having passed three times through the filter 13, . . . , the information of N-words after having passed i-times through the filter 13. Accordingly, there is obtained a musical sound having time-variations in amplitude (tone volume) and tone color — which time variations are determined by the characteristic of the filter 13. For example, in case this filter 13 has a low-pass characteristic, there is obtained a musical sound of such pattern that its higher harmonics components undergo a decay with time. Also, in case the filter 13 has a band-pass characteristic, there is obtained a musical tone of such pattern that the relative levels of the specific harmonics components will become more prominent than other components as the time lapses.

As will be understood from the foregoing explanation, according to the present invention, it is possible to obtain a musical tone whose tone volume and tone color vary with time, by appropriately selecting the characteristic of the filter 13.

Figure 4:
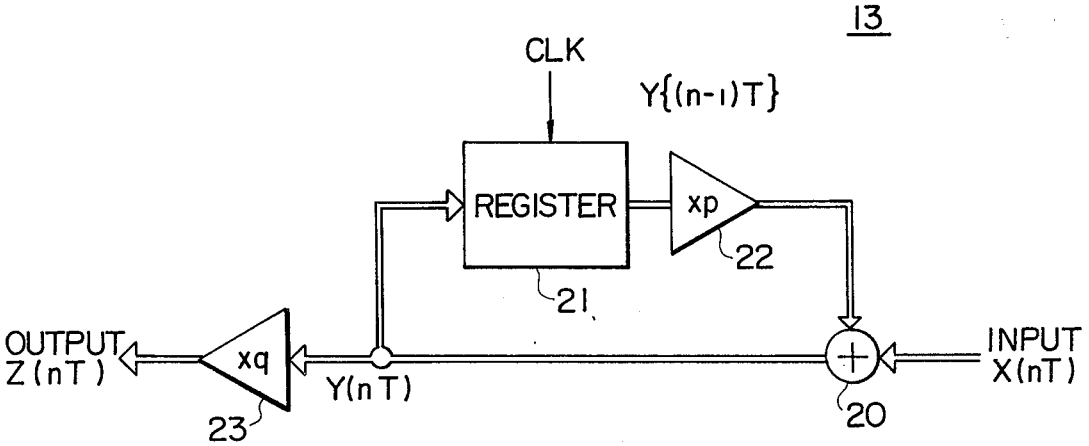
FIG. 4 is a block diagram showing an example of a filter included in the electronic musical instrument shown in FIG. 2.

FIG. 4 shows a concrete example of this filter 13. In FIG. 4, reference numeral 20 represents an adder, 21 a register, and 22 and 23 represent multipliers.

If the input signal of this filter 13, i.e. the output signal of the selector 15A, is designated here as X(nT); the output signal of this filter 13 as Z(nT); and the output signal of the adder 20 as Y(nT), then there is established the following Equations:

$$Y(nT) = X(nT) + p \times Y[(n-1)T] \qquad \text{Eq. (1)}$$

$$Z(nT) = q \times Y(nT) \qquad \text{Eq. (2)}$$

wherein:

p and q represent multiplying coefficients of the multipliers, respectively;

T represents the pulse width of the clock pulse CLK, i.e. the sampling interval; and n represents an integer indicating the number of order of the clock pulse CLK.

On the basis of the above-mentioned Equations (1) and (2), the transfer characteristics (frequency-gain characteristic G and frequency-phase characteristic $\theta$) of the filter are sought as follows:

$$G = q/(1 + p^2 - 2p \cos\omega T)^{\frac{1}{2}} \qquad \text{Eq. (3)}$$

$$\theta = \tan^{-1}(-p \sin\omega T)/(1 - p \cos\omega T) \qquad \text{Eq. (4)}$$

Figure 5:
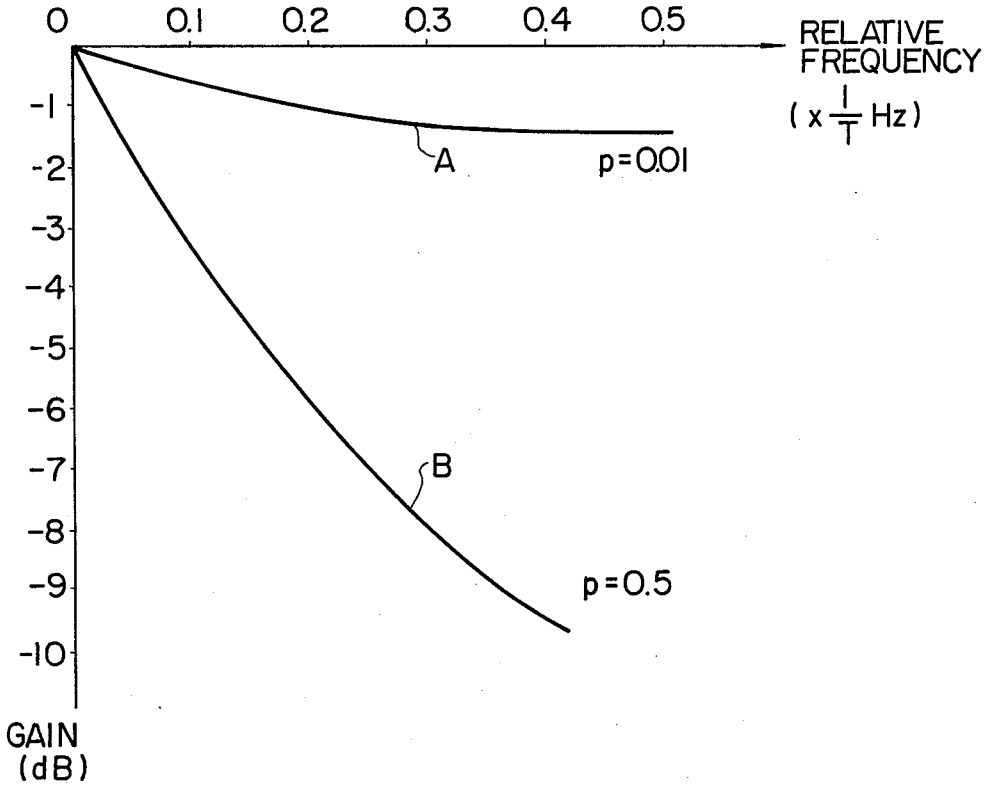
FIG. 5 is a chart of the frequency characteristic of the filter shown in FIG. 4.

In FIG. 5 are shown examples of the frequency-gain characteristic G of the filter 13 shown in FIG. 3. In this figure, the curve A represents the frequency-gain characteristic where the multiplying coefficient p = 0.01 and q = 1-p = 0.99; and the curve B represents the frequency-gain characteristic where p = 0.5 and q = 1-p = 0.5. It should be understood that the vertical axis indicates the gain G in "dB", and that the horizontal axis indicates the fundamental frequency of the musical tone waveshape expressed in terms of the relative frequency for the sampling frequency (1/T).

In the electronic musical instrument of FIG. 2, let us now assume that the waveshape W is comprised of amplitudes at 128 (=N) sampling points and that they are stored in the waveshape memory 11 in the form of digital words, and further that it is intended to obtain a musical sound whose fundamental frequency is 400 Hz. In such an instance, it is apparent that the sampling period, i.e. the period T of the clock pulse CLK, $T = 1/(440 \times 128) = 17.756$ μsec. Now, if the filter 13 of FIG. 2 is assumed to have such frequency-gain characteristic as shown by the curve A ($p = 0.01$, $q = 0.99$) of FIG. 5, the gain G which is obtained by passing the information once through the filter 13, with respect to both the fundamental frequency and the respective higher harmonics, will be expressed as in the following table.

Table

| Frequency components | Relative frequency f' | Gain G (dB) | $G \times \frac{1}{T \times N}$ (dB/sec.) |
|---|---|---|---|
| Fundamental frequency | $f' = 1/128$ | −0.0001 | −0.044 |
| 2nd higher harmonic | $2 \times f_1'$ | −0.0004 | −0.176 |
| 3rd higher harmonic | $3 \times f_1'$ | −0.0010 | −0.440 |
| 4th higher harmonic | $4 \times f_1'$ | −0.0017 | −0.748 |
| . | . | . | . |
| . | . | . | . |
| 16th higher harmonic | $16 \times f_1'$ | −0.0259 | −11.40 |
| . | . | . | . |
| . | . | . | . |
| 32nd higher harmonic | $32 \times f_1'$ | −0.0077 | −38.59 |

In the example of FIG. 2, the waveshape information is circulated in the loop circuit 12 at the rate of $(1/T \times N)$ time per second. Therefore, it will be understood that the gain value: $G \times (1/T \times N)$ which is shown in the rightmost column of the above-mentioned table indicates the rate of decay, per second, of both the fundamental frequency component and the higher harmonic components of the musical tone. As will be clear from this, in case the filter of FIG. 4 is used as the filter 13 of FIG. 2, a musical tone which is obtained in case $p > 0$ will have such characteristic that its lower harmonics components hardly show a decay but the higher harmonics components will decay rapidly with time. This pattern of characteristic closely resembles that of the musical sound which is produced by such musical instrument as a piano or a guitar.

Also, by setting the coefficient value q at various different values, it is possible to impart the filter 13 a gain which is greater than "1" or a decay characteristic greater than those shown in the above-mentioned table, over a certain specific frequency band. As such, there can be obtained a musical tone having an attack and decay envelope resembling that of a natural musical instrument. Also, by setting $p = 0$ 0 and $q = 1$, it is possible to easily generate a musical tone which is constant both in tone volume and tone color.

Figure 6:
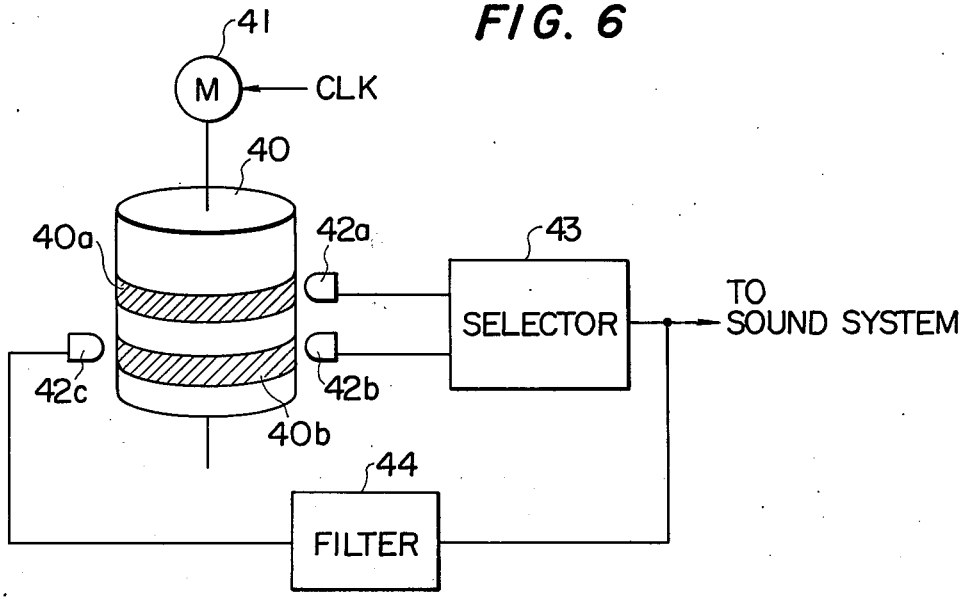
FIG. 6 is an explanatory illustration showing a modification of an electronic musical instrument of the present invention shown in FIG. 2.

In FIG. 6 is shown a modification of the waveshape forming section 100 of FIG. 2. In FIG. 6, reference numeral 40 represents a magnetic drum. On the circumference of this drum 40 are provided magnetic tracks **40*a* and 40*b* which correspond to the waveshape memory 11 and the shift register 14 of FIG. 2, respectively. This magnetic drum 40 is rotated by a motor 41 at the rate corresponding to the frequency of the clock pulse CLK. Reference numerals 42*a* and 42*b* present magnetic heads for reading out the waveshape information stored in the magnetic tracks 40*a* and 40*b*, respectively. A selector 43 shown corresponds to the selector circuit 15A of FIG. 2. A filter 44 illustrated corresponds to the filter 13 of FIG. 2. The output of this filter 44 is written into the magnetic track 40*b* by a magnetic head 42*c*. The above-mentioned selector 42, filter 44, magnetic head 42*c*, magnetic track 40*b* and magnetic head 42*b* jointly constitute a loop circuit corresponding to the loop circuit 12** shown in FIG. 2.

I claim:

1. An electronic musical instrument comprising:

waveshape generating means for generating during a time period of predetermined length a waveshape defining a period of a tone wave to be sounded, said time period being determined according to a frequency of a musical tone to be produced by said musical instrument; and a loop circuit connected to said waveshape generating means for receiving said waveshape of said length, and including a filter and a delay means connected in a loop for repetitively circulating therein said waveshape, and having a delay time equal to the length of said predetermined time period, providing thereby for a period of said signal to circulate in the loop circuit once, said loop circuit delivering out a musical tone signal having said frequency.

2. An electronic musical instrument according to claim 1 wherein:

said waveshape generating means includes a waveshape memory storing said waveshape, and readout circuitry, connected to said waveshape memory for reading out said waveshape.

3. An electronic musical instrument according to claim 2, wherein: said waveshape memory is of such a type as stores said waveshape in a digital representation.

4. An electronic musical instrument according to claim 3, wherein: said digital representation comprises a plurality of digital words representing the amplitudes at successive sample points of said waveshape.

5. An electronic musical instrument according to claim 1, which further comprises: means for selecting said certain time.

6. An electronic musical instrument comprising:

a waveshape memory storing digital words of N number, these digital words representing the amplitudes at N sample points of a certain waveshape, respectively;

means for generating a clock pulse of a selectable frequency, said digital words being read out, one after another, from said waveshape memory for each arrival of said clock pulse;

a selector having a first and a second input terminal and an output terminal which is selectively connectable to either said first input terminal or said second input terminal;

a filter having an input terminal connected to said output terminal of said selector, and an output terminal;

a counter for counting said clock pulse to deliver a switch-over signal to said selector when said digital words of N number are all read out from said waveshape memory, said selector being operative so that it makes a connection between its output terminal and its first input terminal in the absence of said switch-over signal and that it makes a connection between its output terminal and its second terminal in the presence of said switch-over signal; and an N-stage shift register having an input terminal connected to said output terminal of said filter and an output terminal connected to said second input terminal of said selector, the shift register being operative so that the contents of the respective stages of this shift register are shifted one position towards the output terminal thereof for each arrival of said clock pulse;

there being obtained at said output terminal of said selector an aimed musical waveshape in digital representation.

7. An electronic musical instrument according to claim 6, in which: said filter comprises:

an adder for algebraically summing two digital words applied thereto, one of these two digital words being the one applied at said input terminal of said filter;

a first multiplier for multiplying, by a first coefficient, the digital words resulted from the summation by said adder, the digital word resulted from the multiplication by this first multiplier being delivered to said output terminal of said filter;

another shift register for being inputted with said digital word delivered from said adder, the contents of the respective stages of this shift register being shifted one position toward the output stage thereof for each arrival of said clock pulse; and a second multiplier for multiplying, by a second coefficient, the digital word delivered from said another shift register, the digital word resulted from multiplication by this second multiplier being applied to said adder as the other one of said two digital words applied to said adder.

8. In an electronic musical instrument of the type comprising a waveshape generator for providing a signal indicative of at least one period of a predetermined waveform, and a recirculating loop receptive of said waveform signal for modifying said waveform to provide an output signal, said output signal being provided at an output terminal and representative of a musical tone, the improvement wherein:

said loop comprises a filter of predetermined transfer function operating upon said output signal;

a delay circuit, interposed between said filter and said output terminal, said delay circuit providing a delay in accordance with said waveform period such that each successive cycle of said output signal is indicative of said predetermined waveform operated upon by said transfer function a respective increasing number of times; and a selector for initially coupling said waveform signal directly to said output terminal for the first period of said output signal such that the first cycle of said output signal is determined by said predetermined waveform, and thereafter decoupling said waveshape generator from said output signal such that said output signal is generated by said delay means.

9. An electronic instrument of claim 8 wherein said waveshape generator comprises:

a memory for storing a predetermined number of digital words, said words representing the amplitudes of said predetermined waveform at respective sample points; and said delay circuit comprises a shift register having a number of stages equal to said predetermined number.

* * * * *